US010910731B2

(12) United States Patent
Biancotto et al.

(10) Patent No.: US 10,910,731 B2
(45) Date of Patent: Feb. 2, 2021

(54) HIGH PERFORMANCE FLAT PANEL ANTENNAS FOR DUAL BAND, WIDE BAND AND DUAL POLARITY OPERATION

(71) Applicant: CommScope Technologies LLC, Hickory, NC (US)

(72) Inventors: Claudio Biancotto, Edinburgh (GB); David Walker, Glasgow (GB); Ian Renilson, Fife (GB)

(73) Assignee: CommScope Technologies LLC, Hickory, NC (US)

( * ) Notice: Subject to any disclaimer, the term of this patent is extended or adjusted under 35 U.S.C. 154(b) by 10 days.

(21) Appl. No.: 16/329,250

(22) PCT Filed: Aug. 18, 2017

(86) PCT No.: PCT/US2017/047545
§ 371 (c)(1),
(2) Date: Feb. 28, 2019

(87) PCT Pub. No.: WO2018/048605
PCT Pub. Date: Mar. 15, 2018

(65) Prior Publication Data

US 2019/0190165 A1 Jun. 20, 2019

Related U.S. Application Data

(60) Provisional application No. 62/384,829, filed on Sep. 8, 2016.

(51) Int. Cl.
*H01Q 21/24* (2006.01)
*H01Q 5/25* (2015.01)
(Continued)

(52) U.S. Cl.
CPC ..... *H01Q 21/24* (2013.01); *H01Q 1/523* (2013.01); *H01Q 5/25* (2015.01); *H01Q 9/04* (2013.01); *H01Q 21/06* (2013.01); *H01Q 21/065* (2013.01)

(58) Field of Classification Search
CPC ..... H01Q 21/24; H01Q 21/06; H01Q 9/04; H01Q 1/523; H01Q 21/065; H01Q 5/25;
(Continued)

(56) References Cited

U.S. PATENT DOCUMENTS 10,381,880 B2 * 8/2019 Leabman ..... H02J 7/025
2010/0259346 A1 10/2010 Runyon
(Continued)

FOREIGN PATENT DOCUMENTS

CN 104682018 A 6/2015
CN 204966703 U 1/2016
(Continued)

OTHER PUBLICATIONS

Notification of Transmittal of the International Search Report and the Written Opinion of the International Searching Authority, or the Declaration, in corresponding PCT Application No. PCT/US2017/047545 (dated Nov. 24, 2017).
(Continued)

*Primary Examiner* — Daniel D Chang
(74) *Attorney, Agent, or Firm* — Myers Bigel, P.A.

(57) ABSTRACT

A flat panel antenna is provided. The flat panel antenna may include a plurality of flat panel arrays (FPAs) that are arranged adjacent one another. Ones of the plurality of FPAs are configured to radiate in a plurality of different respective frequency bands and/or at different respective polarizations. The flat panel antenna includes an enclosure that defines an internal cavity that includes the plurality of FPAs.

22 Claims, 10 Drawing Sheets

(51) Int. Cl.
*H01Q 1/52* (2006.01)
*H01Q 21/06* (2006.01)
*H01Q 9/04* (2006.01)

(58) Field of Classification Search
CPC ... H01Q 21/0006; H01Q 21/061; H01Q 21/30
See application file for complete search history.

(56) References Cited

U.S. PATENT DOCUMENTS

| | | | | |
|---|---|---|---|---|
| 2011/0316734 | A1 | 12/2011 | Svensson | |
| 2014/0354221 | A1* | 12/2014 | Leabman ..... | H04B 5/0037 320/108 |
| 2014/0368395 | A1 | 12/2014 | Dauguet et al. | |
| 2015/0130671 | A1 | 5/2015 | Cordone | |
| 2016/0020647 | A1* | 1/2016 | Leabman ..... | H02J 7/025 307/104 |
| 2016/0233588 | A1 | 8/2016 | Bily et al. | |

FOREIGN PATENT DOCUMENTS

| | | | |
|---|---|---|---|
| DE | 10240494 | A1 | 3/2004 |
| JP | S63174413 | A | 7/1988 |

OTHER PUBLICATIONS

Chinese Office Action corresponding to Chinese Application No. 201780044544.X (13 pages, foreign text; 10 pages, English translation) (dated Jun. 1, 2020).
Extended European Search Report Corresponding to European Application No. 17849298.9 (14 pages) (dated Mar. 31, 2020).

* cited by examiner

HIGH PERFORMANCE FLAT PANEL ANTENNAS FOR DUAL BAND, WIDE BAND AND DUAL POLARITY OPERATION

CLAIM OF PRIORITY

The present application is a 35 U.S.C. § 371 national stage application of PCT Application No. PCT/US2017/047545, filed on Aug. 18, 2017, which itself claims the benefit of and priority under 35 U.S.C. § 119 to U.S. Provisional Patent Application No. 62/384,829, filed Sep. 8, 2016, the entire contents of which are incorporated by reference herein in their entireties. The above-referenced PCT Application was published in the English language as International Publication No. WO 2018/048605 A1 on Mar. 15, 2018.

FIELD

The present invention relates generally to communications systems and, more particularly, to flat panel antennas utilized in microwave communications systems.

BACKGROUND

Flat panel antennas technology may not be extensively used in the licensed commercial microwave point-to-point or point-to-multipoint market, where more stringent electromagnetic radiation envelope characteristics consistent with efficient spectrum management may be more common. Antenna solutions derived from traditional reflector antenna configurations, such as prime focus fed axi-symmetric geometries, can provide high levels of antenna directivity and gain at relatively low cost. However, the extensive structure of a reflector dish and associated feed may require enhanced support structure to withstand wind loads, which may increase overall costs. Further, the increased size of reflector antenna assemblies and the support structure required may be viewed as a visual blight.

Flat panel arrays may be formed, for example, using waveguide or printed slot arrays in resonant or travelling wave configurations. Resonant configurations typically cannot achieve the desired electromagnetic characteristics over the bandwidths utilized in the terrestrial point-to-point market sector, while travelling wave arrays typically provide a main beam radiation pattern which moves in angular position with frequency. Because terrestrial point-to-point communications generally operate with transmit/receive channels spaced over different parts of the frequency band being utilized, movement of the main beam with respect to frequency may prevent simultaneous efficient alignment of the link for both channels.

When used in wide-band applications, especially in dual polarization operation, conventional flat panel antennas having high electrical performance, low production costs and low complexity may be difficult to design. Additional equipment such as diplexers may result in undesirable increases in system complexity.

SUMMARY

Some embodiments of the inventive concept are flat panel antennas. For example, a flat panel antenna may include a plurality of flat panel arrays (FPAs) that are arranged adjacent one another. Some embodiments provide that ones of the plurality of FPAs are configured to radiate in a plurality of different respective frequency bands and/or at different respective polarizations. The antenna may include an enclosure that defines an internal cavity that includes the plurality of FPAs.

In some embodiments, the plurality of FPAs comprises a first FPA that is operable to radiate electromagnetic energy having a vertical polarization and a second FPA that is operable to radiate electromagnetic energy having a horizontal polarization. Some embodiments provide that the plurality of FPAs comprise a first FPA that is configured to exclusively operate in a transmit mode and a second FPA that is configured to exclusively operate in a receive mode.

In some embodiments, the plurality of FPAs comprise a first FPA that is configured to operate in a first frequency band and a second FPA that is configured to operate in a second frequency band that is different from the first frequency band. Some embodiments provide that the first frequency band and the second frequency band are narrow bands. In some embodiments, the first frequency band comprises a 71-76 GHz frequency band and the second frequency band comprises a 81-86 GHz frequency band. Some embodiments provide that the first frequency band and the second frequency band combine to transmit and/or receive electromagnetic energy in a wide band.

In some embodiments, the plurality of FPAs comprise a first FPA that is configured to operate in a first frequency band and a second FPA that is operable to radiate electromagnetic energy in the first frequency band. In some embodiments, a polarization of the first FPA may be orthogonal relative to a polarization of the second FPA. In some embodiments, the polarization difference between the first FPA and the second FPA is about ninety degrees.

Some embodiments provide that the plurality of FPAs further comprise a third FPA that is configured to operate in a second frequency band and a fourth FPA that is operable to radiate electromagnetic energy in the second frequency band. In some embodiments, a polarization of the third FPA may be orthogonal relative to a polarization of the fourth FPA. In some embodiments, the polarization difference between the third FPA and the fourth FPA is about ninety degrees.

In some embodiments, the plurality of FPAs comprise a first FPA that is operable to transmit and/or receive electromagnetic energy having a vertical polarization in a first frequency band, a second FPA that is operable to transmit and/or receive electromagnetic energy having a horizontal polarization in the first frequency band, a third FPA that is operable to transmit and/or receive electromagnetic energy having, the vertical polarization in a second frequency band that is different from the first frequency band and a fourth FPA that is operable to transmit and/or receive electromagnetic energy having the horizontal polarization in the second frequency band.

Some embodiments provide that the first FPA and the third FPA are configured to be coupled to a first radio and the second FPA and the fourth FPA are configured to be coupled to a second radio. In some embodiments, the first FPA and the third FPA are configured to transmit the electromagnetic energy and the second FPA and the fourth FPA are configured to receive the electromagnetic energy. In some embodiments, the first, second, third and fourth FPAs are arranged in a two column, two row configuration. Some embodiments provide that the second FPA is in a first row and a first column, the third FPA is in the first row and a second column, the fourth FPA is in a second row and the first column, and the first FPA is in the second row and the second column.

In some embodiments, each of the plurality of FPAs is a rectangular shaped FPA and has a polarization direction that extends diagonally across the rectangular shaped FPA from a first corner to a second corner that is opposite the first corner. Some embodiments provide that the plurality of FPAs comprise a first FPA that is operable to transmit and/or receive electromagnetic energy having a vertical polarization in a first frequency band, a second FPA that is operable to transmit and/or, receive electromagnetic energy having a horizontal polarization in the first frequency band, a third FPA that is operable to transmit and/or receive electromagnetic energy having the vertical polarization in a second frequency band that is different from the first frequency band and a fourth FPA that is operable to transmit and/or receive electromagnetic energy having the horizontal polarization in the second frequency band.

Some embodiments provide that the plurality of FPAs are arranged in a diamond shaped configuration and the enclosure is substantially rectangular and is arranged such that a corner of each of the plurality of FPAs is positioned along a corresponding side of the enclosure.

In some embodiments, the plurality of FPAs are arranged in a diamond shaped configuration and the enclosure is substantially diamond shaped and is arranged such that each corner of the enclosure is positioned adjacent a corner of a different one of the plurality of FPAs.

In some embodiments, the plurality of FPAs comprise a first FPA that is configured to operate in a first frequency band and a second FPA that is configured to operate in a second frequency, band that is different from the first frequency band. In some embodiments the antenna may further include a first radio that is coupled to the first FPA, a second radio that is coupled to the second FPA and a diplexer that is coupled to the first radio and the second radio.

Some embodiments provide that the first frequency band and the second frequency band are each a narrow frequency band channel and that the diplexer is operable to combine a first frequency band channel from the first radio and a second frequency band channel from the second radio into a wideband channel in a receive mode.

In some embodiments, the first frequency band and the second frequency band are each a narrow frequency band channel and the diplexer is operable to separate a wideband channel into a first frequency band channel and a second frequency band channel in a transmit mode.

Some embodiments further include at least one electromagnetic decoupling structure that is positioned adjacent one or more of the plurality of FPAs and that is configured to reduced electromagnetic interference between ones of the plurality of FPAs.

In some embodiments, the enclosure comprises a radio mounting structure that is configured to attach at least one radio that is coupled to at least one of the plurality or FPAs to the flat panel antenna.

Some embodiments of the present inventive concept are directed to methods of manufacturing a flat panel antenna. Such methods may include providing a plurality of flat panel arrays (FPAs) that are arranged adjacent one another, wherein ones of the plurality of are configured to operate in a plurality of different respective frequency bands and/or at different respective polarizations and providing, an enclosure that defines an internal cavity that includes the plurality of FPAs.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given, above, and the detailed description of the embodiments given below, serve to explain the principles of the invention.

DETAILED DESCRIPTION

Flat panel array antennas may be formed in multiple layers via machining or casting. For example, U.S. Pat. No. 8,558,746 to Thomson et al. (the disclosure of which is hereby incorporated by reference herein in its entirety) discusses a flat panel array antenna constructed as a series of different layers. Shown therein are flat panel arrays that include input, intermediate and output layers, with some embodiments including one or more slot layers and one or more additional intermediate layers. The layers are manufactured separately (typically via machining or casting) and stacked to form a flat panel antenna having an integrated feed network.

Figure 1:
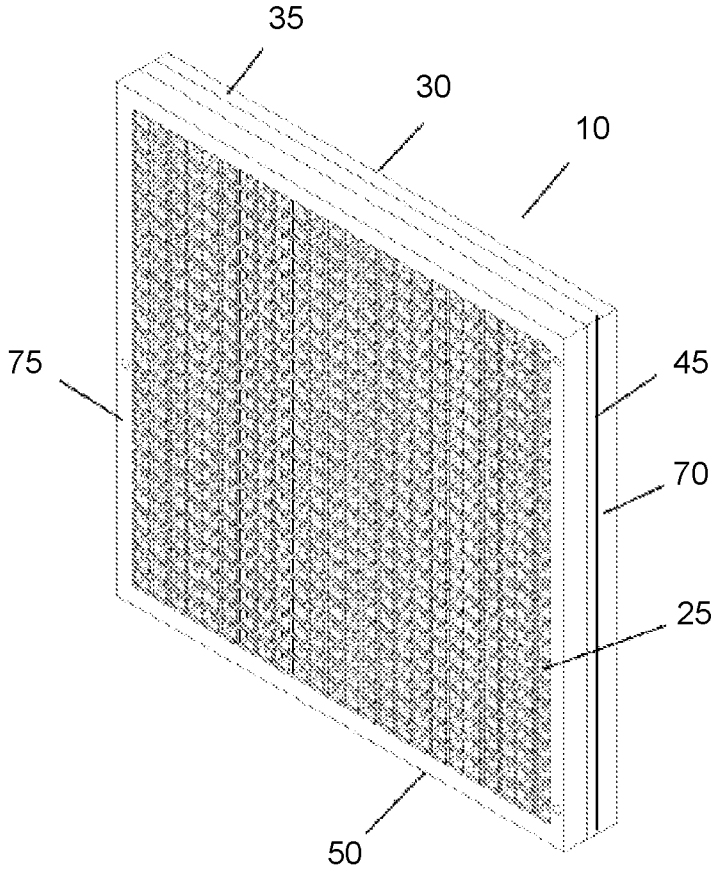
FIG. 1 (Prior Art)
FIG. 1 is a schematic isometric angled front view of a conventional flat panel antenna.

Brief reference is made to FIG. 1, which is a schematic isometric angled front view off conventional flat panel antenna. As illustrated, a flat panel array antenna 10 may be formed from several layers each with surface contours and apertures combining to form a feed horn array and RF path comprising a series of enclosed coupling cavities and interconnecting waveguides when the layers are stacked upon one another.

The RF path may include a waveguide network coupling an input feed to a plurality of primary coupling cavities. Some embodiments provide that each of the primary coupling cavities may include four output ports that each may be coupled to a horn radiator 25.

The input feed may be positioned generally central on a first side 30 of an input layer 35, for example to allow compact mounting of a microwave transceiver thereto, using antenna mounting features (not shown) that may be interchangeable with those used with traditional reflector antennas. Some embodiments provide that, the input feed may be positioned at a layer sidewall between the input layer 35 and a first intermediate layer 45 enabling, for example, an antenna side by side with the transceiver configuration where the depth of the resulting flat panel antenna assembly may be reduced.

In some embodiments, a waveguide network may be provided on a second side 50 of the input layer 35 and a first side 30 of the first intermediate layer 45. Some embodiments provide that the waveguide network may be provided with a rectangular waveguide cross section, a long axis of the rectangular cross section normal to a surface plane of the input layer 35. In some embodiments, the waveguide network may be configured wherein a long axis of the rectangular cross section is parallel to a surface plane of the input layer 35 and/or may be configured wherein a long axis of the rectangular cross-section is parallel to a surface plane of the input layer 35. A seam 70 between the input layer 35 and the first intermediate layer 45 may be applied at a midpoint of the waveguide cross section.

The waveguide network may distribute the RF signals to and from the input feed to a plurality of primary coupling cavities provided on a second side, of the intermediate layer 45. The waveguide network may be dimensioned to provide an equivalent length electrical path to each primary coupling cavity to ensure common phase and amplitude. Some embodiments provide that the waveguide sidewalls of the waveguide network may also be provided with surface features for impedance matching, filtering and/or attenuation.

The output layer 75 may be a monolithic layer including the array of horn radiators 25 on the second side 50 thereof, and a plurality of output ports (not shown) for the primary coupling cavities on the first side that is opposite the second side 50. The output ports may be generally rectangular in configuration, and multiple (for example, four) of the output ports may be coupled to each of the primary coupling cavities. Each of the output ports may also be coupled to one of the horn radiators 25 by one or more polarization rotator elements (not shown) that are integrated in the output layer 75. For example, the output ports, horn radiators 25, and polarization rotator elements may be machined into the monolithic output layer 75 from the first side and/or the second side 50 thereof.

In some embodiments described herein, the polarization rotator elements include one or more multi-sided slots or openings in the output layer 75 that couple each output port to one of the horn radiators 25. In some embodiments, the polarization rotator elements include elongated, generally diamond-shaped slots or openings. One of the generally diamond-shaped slots may be in communication with each of the output ports, and may couple each of the output ports to an inlet port at a base of one of the horn radiators 25. In some embodiments, the horn radiators 25, the inlet ports, the slots, the openings, and/or the output ports may include one or more radiused corners and/or ends resulting from the machining process.

The input layer 35, intermediate layer 45 and/or output layer 75 may be assembled using various techniques, including but not limited to mechanical fixings, brazing, diffusion bonding, and lamination. For example, two or more of the layers 35, 45, and/or 75 may be joined by a brazing process, using a filler metal (having a lower melting point than the layers) at the seams between the layers. Additionally or alternatively, two or more of the layers 35, 45, and/or 75 may be joined using a diffusion bonding process, by clamping two or more of the layers together with respective surfaces abutting, and applying pressure and heat to bond the layers. Such brazing and/or diffusion bonding processes can provide very good bonding between plates, which may result in lower electrical losses and/or reduced or minimized RF leakage. In some embodiments, two or more of the different layers may be formed as a monolithic unit.

As frequency increases, wavelengths decrease. Therefore, as the desired operating frequency increases, the physical features within a corporate waveguide network, such as steps, tapers and T-type power dividers, may become smaller and harder to fabricate. As use of the coupling cavities can simplify the waveguide network requirements, one skilled in the art will appreciate that higher operating frequencies are enabled by the present flat panel antenna.

It will be understood that, as described herein, various attributes of an antenna array, such as beam elevation angle, beam azimuth angle, and half power beam width, may be determined based on the magnitude and/or phase of the signal components that are fed to each of the radiating elements. The magnitude and/or phase of the signal components that are fed to each of the radiating elements may be adjusted so that the flat panel antenna will exhibit a desired antenna coverage pattern in terms of, for example, beam elevation angle, beam azimuth angle, and half power beam width. The desired frequency range of operation may determine the sizes, dimensions, and/or spacings of the elements of the antenna array.

Some embodiments of the present invention provide apparatus and methods that provide high performance antenna operation using, flat panel antennas that include multiple flat panel arrays in a single enclosure to provide multiple band, dual polarization performance as a single solution with less complex fabrication than a single array flat panel antenna to provide electrical performance approaching that of much larger traditional reflector antennas.

Figure 2:
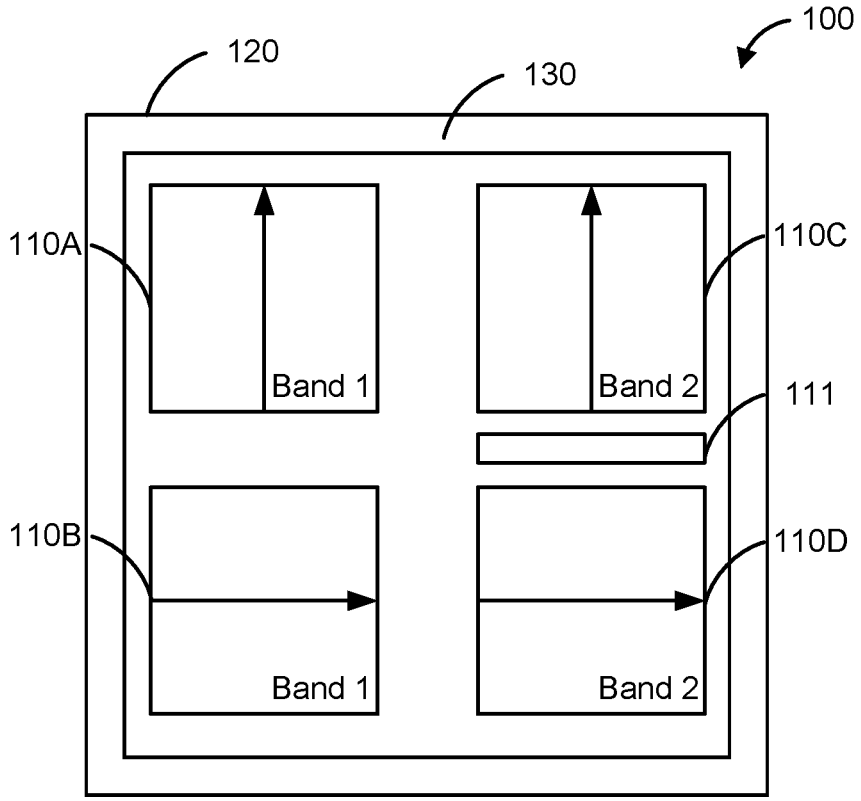
FIG. 2 is a schematic block diagram illustrating a flat panel antenna for dual band, wide band and dual polarity operation according to some embodiments of the present invention.

Reference is now made to FIG. 2, which is a schematic block diagram illustrating a flat panel antenna 100 for dual band, wide band and dual polarity operation according to some embodiments of the present invention. As illustrated, the flat panel antenna 100 may include a single enclosure 120 that includes an internal cavity in which multiple flat panel arrays (FPAs) 110 may be provided (namely, FPAs 110-A-110D). In some embodiments, the single enclosure includes a back panel, a plurality of sidewalls and a front panel. Any and/or all of the back panel, ones of the plurality of sidewalls and/or the front panel may be fixed relative to other ones thereof and/or may be removable to access the internal cavity and/or portions thereof. The back panel, ones of the plurality of sidewalls and/or the front panel may each include an electrically conductive material and/or an electrically insulating material, such as a dielectric material.

The multiple FPAs 110 may be arranged adjacent one another and may be configured to operate in a plurality of different respective frequency bands and/or at different respective polarizations. For example, as illustrated, FPA 110A may be configured to operate in a first frequency band and to transmit and/or receive electromagnetic energy having a vertical polarization, FPA 110B may be configured to operate in the first frequency band and to transmit and/or receive electromagnetic energy having a horizontal polarization, FPA 110C may be configured to operate in a second frequency band and to transmit and/or receive electromagnetic energy having a vertical polarization, and FPA 110D may be configured to operate in the second frequency band and to transmit and/or receive electromagnetic energy having a horizontal polarization.

In some embodiments, the flat panel antenna 100 may be used as a wideband dual polarization antenna. For example, in some embodiments, wide bandwidth, antennas are needed that operate in both the 71-76 GHz and 81-86 GHz frequency bands. The flat panel antenna 100 may accomplish this using different FPAs 110 that may be configured to operate in two different frequency bands. In this regard, FPAs 110A and 110B may each operate in the lower frequency band (i.e., first frequency band) of 71-76 GHz. Similarly, FPAs 110C and 110D may each operate in the upper frequency band (i.e., second frequency band) of 81-86 GHz. Some embodiments provide that the two different frequency bands are substantially non-adjacent on the frequency spectrum. For example, a first frequency band may be around 23 GHz while the second frequency band may be around 80 GHz. Such examples are non-limiting as the first and second frequency bands may include frequency bands that are lower than, higher than, and/or in between those listed herein.

Some embodiments provide that dual polarization operation may be achieved using different FPAs 110 that are configured to transmit and/or receive electromagnetic energy having different polarizations. As used herein, the polarization of an electromagnetic signal may refer to the approximate angle between the ground and the electric field of the electromagnetic signal. In some embodiments, the different polarizations may be substantially orthogonal relative to one another. For example, FPAs 110A and 110C may be operable to radiate electromagnetic energy having a substantially vertical polarization while FPAs 110B and 110D may be operable to radiate electromagnetic energy having a substantially horizontal polarization. While not illustrated in the current example, the different ones of the FPAs 110 may be +/−45 degrees versus vertical and horizontal, and/or may have right-handed circular polarization (RHCP) and/or left-handed circular polarization (LHCP).

Some embodiments provide that different ones of the FPAs 110 may be configured to operate exclusively in either a transmit mode or a receive mode. For example, as illustrated, FPA 110A may be configured to operate in a transmit mode and thus operate to transmit electromagnetic energy in the first frequency band having a vertical polarization and FPA 110B may be configured to operate in a receive mode and thus operate to receive electromagnetic energy in the first frequency band and having a horizontal polarization.

Similarly, FPA 110C may be configured to operate in a transmit mode and thus operate to transmit electromagnetic energy in the second frequency band and having a vertical polarization and FPA 110D may be configured to operate in receive mode and thus operate to receive electromagnetic energy in the second frequency band and having a horizontal polarization.

In some embodiments, the flat panel antenna 100 may include antenna circuitry 130 which may provide, interconnection, coordination, control and/or configuration of the FPAs 110. For example, various filters, duplexers, diplexers and/or orthomode transducers (OMTs) may be included in the flat panel antenna 100, depending on the desired mode of operation.

Although not illustrated, the flat panel antenna 100 may include an electromagnetic decoupling structure 111 that may include one or more metal and/or dielectric spacers within the enclosure 120 arranged relative to the different ones of the FPAs 110. In some embodiments, the metal and/or dielectric spacers may reduce or eliminate electromagnetic interference between different ones of the FPAs 110. Additionally, different ones of the FPAs 110 may include different polarizations and/or orientations to reduce and/or eliminate electromagnetic interference.

Figure 3:
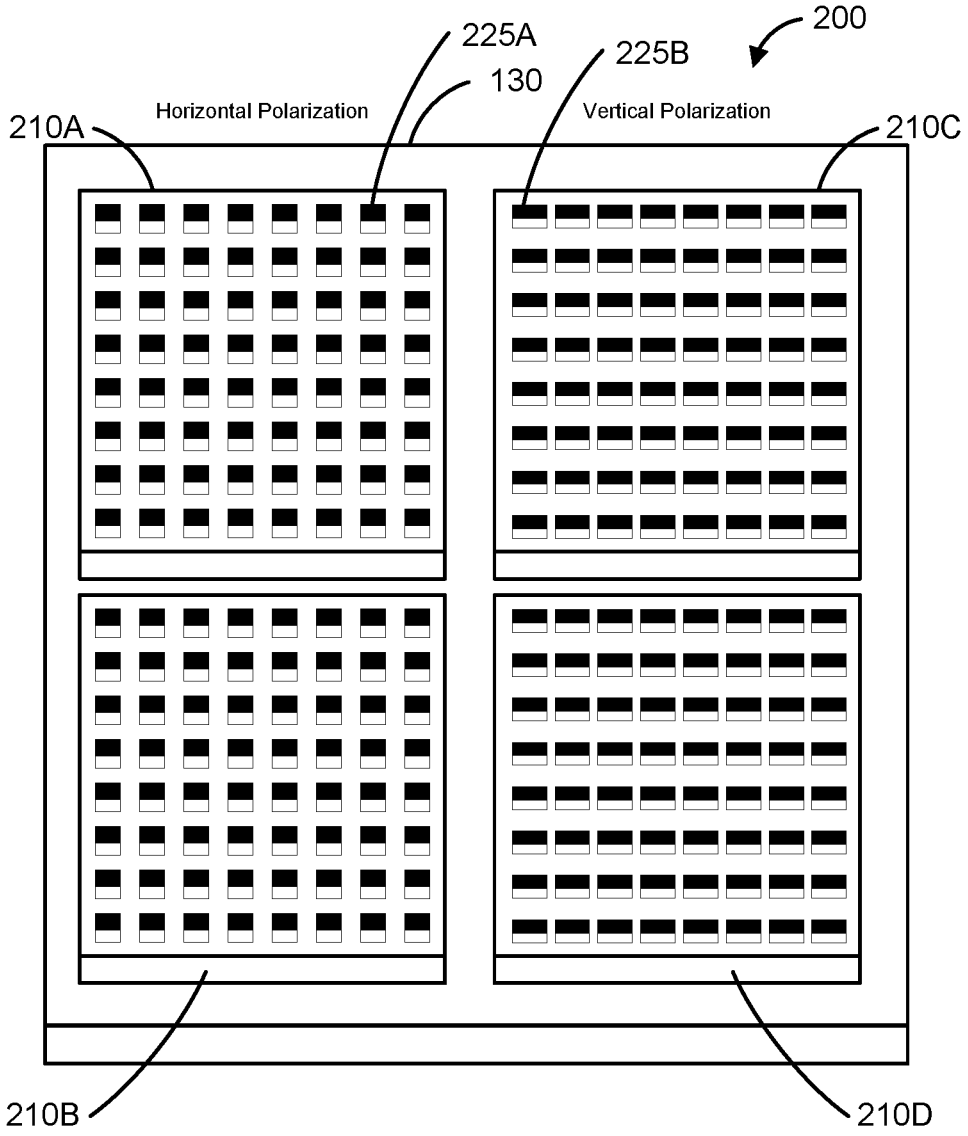
FIG. 3 is a schematic diagram illustrating a flat panel antenna for dual band, wide band and dual polarity operation according to some embodiments of the present invention.

Brief reference is now made to FIG. 3, which is a schematic three-dimensional diagram illustrating a flat panel antenna 200 for dual band, wide band and dual polarity operation according to some embodiments of the present invention. The flat panel antenna 200 may include multiple FPAs 210 that may transmit and/or receive electromagnetic energy having different polarizations. For example, FPAs 210A and 210B may include radiators 225A that are shaped and oriented to transmit and/or receive electromagnetic energy that is horizontally polarized. In contrast, FPAs 210C and 210D may include radiators 225B that are shaped and oriented to transmit and/or receive electromagnetic energy that is vertically polarized. As discussed above regarding FIG. 2, some embodiments provide that some of the FPAs 210 are configured to operate in a first frequency band while other of the FPAs 210 may be configured to operate in a second frequency band that is different from the first frequency band. In some embodiments the first and second frequency bands may be substantially narrow frequency bands and may be substantially adjacent one another on a frequency spectrum. In some embodiments, the first frequency band and the second frequency band may be combined to transmit and/or receive electromagnetic energy in a wide band that includes multiple narrow frequency bands.

Figure 4:
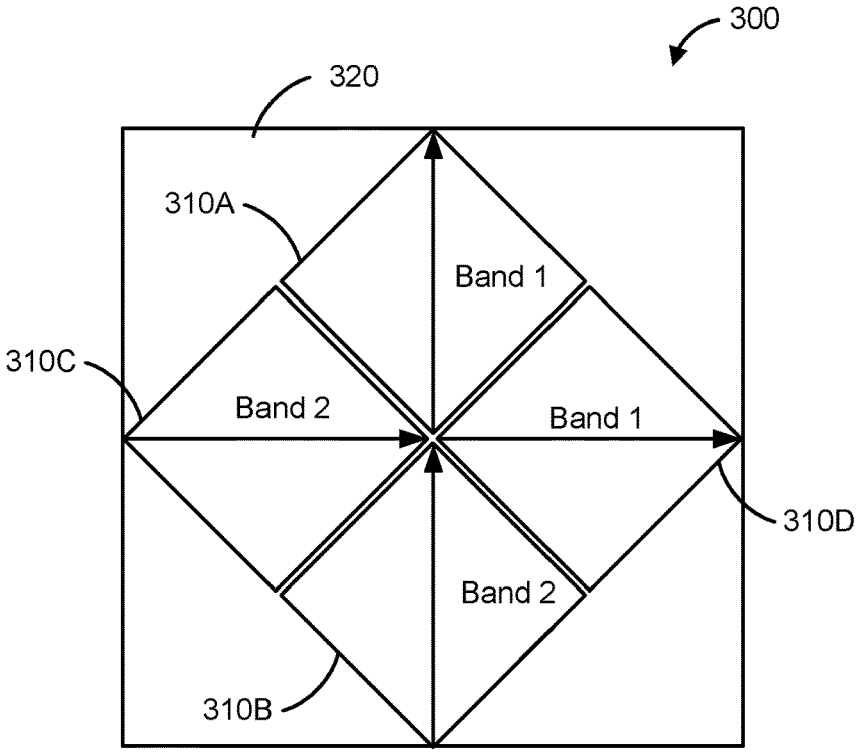
FIG. 4 is a schematic diagram illustrating a diamond arrangement of a flat panel antenna for dual band, wide band and dual polarity operation according to some embodiments of the present invention.

Reference is now made to FIG. 4, which is a schematic diagram illustrating a diamond arrangement of a flat panel antenna for dual band, wide band and dual polarity operation according to some embodiments of the present invention. A flat panel antenna 300 may include a plurality of FPAs 310 that may each be substantially square and/or rectangular and that each are operable to transmit and/or receive electromagnetic energy having a polarization that is diagonally oriented relative to the FPA 310. For example, the polarization direction may be generally arranged from corner to opposing corner of each FPA 310 instead of from side to opposing side thereof.

In some embodiments, each of the FPAs 310 may be oriented to present a diamond shape such that the diagonals of each FPA 310 define horizontal or vertical lines and the sides of each FPA 310 define an angle of about 45 degrees relative to the horizontal or vertical. Some embodiments provide that multiple FPAs 310 may be arranged in a generally diamond formation such that the shape of the combined FPAs 310 may define a diamond shape.

In some embodiments, the multiple FPAs 310 may include a top FPA 310A that is configured to operate in a first frequency band and to transmit and/or receive electromagnetic energy having a vertical polarization, FPA 310B may be configured to operate in a second frequency band and to transmit and/or receive electromagnetic energy having a vertical polarization, FPA 310C may be configured to operate in the second frequency band and to transmit and/or receive electromagnetic energy having a horizontal polarization, and FPA 310D may be configured to operate in the first frequency band and to transmit and/or receive electromagnetic energy having a horizontal polarization.

Some embodiments provide that the multiple FPAs 310 may be arranged in an enclosure 320. Some embodiments provide that the enclosure 320 is generally rectangular or square and may be dimensioned based on the height and width of the plurality of FPAs 310 that are arranged in the diamond formation.

Figure 5:
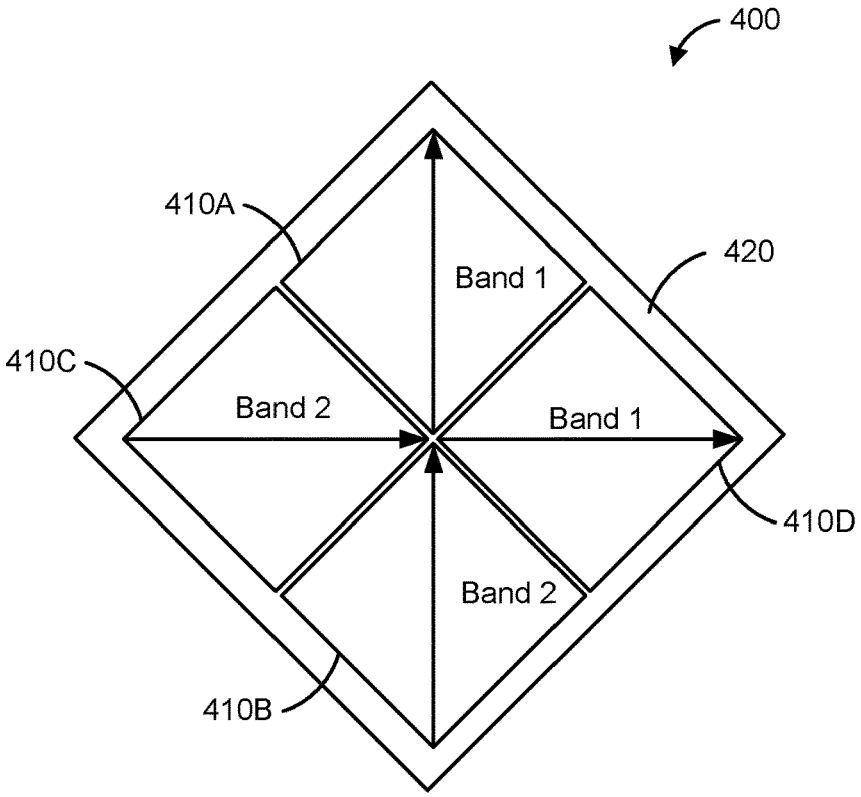
FIG. 5 is a schematic diagram illustrating another diamond arrangement of a flat panel antenna for dual band, wide band and dual polarity operation according to some embodiments of the present invention.

Brief reference is now made to FIG. 5, which is a schematic diagram illustrating another diamond arrangement of a flat panel antenna for dual band, wide band and dual polarity operation according to some embodiments of the present invention. The flat panel antenna 400 may include multiple FPAs 410 that may be configured and arranged in a manner described above regarding FIG. 4. As such, additional discussion thereof will be omitted.

In contrast with the enclosure 320 of FIG. 4, the flat panel antenna 400 includes an enclosure 420 that is oriented to be in a diamond configuration that substantially matches the generally diamond formation corresponding to the shape of the combined FPAs 410. In this manner, the enclosure 420 may be sized smaller than that of enclosure 320 and thus may result in a reduced cost thereof.

In some embodiments, more than four of the FPAs may be included in a flat panel antenna. For example, some embodiments provide that 6, 8 or more FPAs may be included in a single flat panel antenna. Similarly, some embodiments provide that less than 4 FPAs may be used in a flat panel antenna. For example, brief reference is now made to FIG. 6, which is a schematic block diagram illustrating a flat panel antenna for single band and dual polarity operation according to some embodiments of the present invention. The flat panel antenna 600 may include at least two FPAs 610 that may be operable to transmit and/or receive electromagnetic energy having different polarizations in the same frequency band. For example, FPA 610A may be configured to transmit and/or receive electromagnetic energy having a substantially vertical polarization and 610B may be configured to transmit and/or receive electromagnetic energy having a substantially horizontal polarization.

In some embodiments, one of the FPAs 610 may be configured to operate in a transmit mode and the other one of the FPAs 610 may be configured to operate in a receive mode. Some embodiments provide that each of the FPAs 610 is configured to both transmit and receive. For example, operating both of the FPAs 610 in the same of the transmit, receive and/or transmit and receive modes may provide redundant electromagnetic signals that provide an error correction function.

In some embodiments, the flat panel antenna 600 may include antenna circuitry 630 which may provide, interconnection, coordination, control and/or configuration of the FPAs 610. For example, various filters, duplexes, diplexers and/or orthomode transducers (OMTs) may be included in the flat panel antenna 600, depending on the desired mode of operation. As illustrated, the flat panel antenna 600 may include a single enclosure 620 that includes an internal cavity in which multiple flat panel arrays (FPAs) 610 may be provided. Other than dimensions, the enclosure 620 may include the same features as discussed above regarding FIG. 2. As such, additional description thereof will be omitted. In some embodiments, the single enclosure includes a back panel, a plurality of sidewalls and a front panel.

Figure 7:
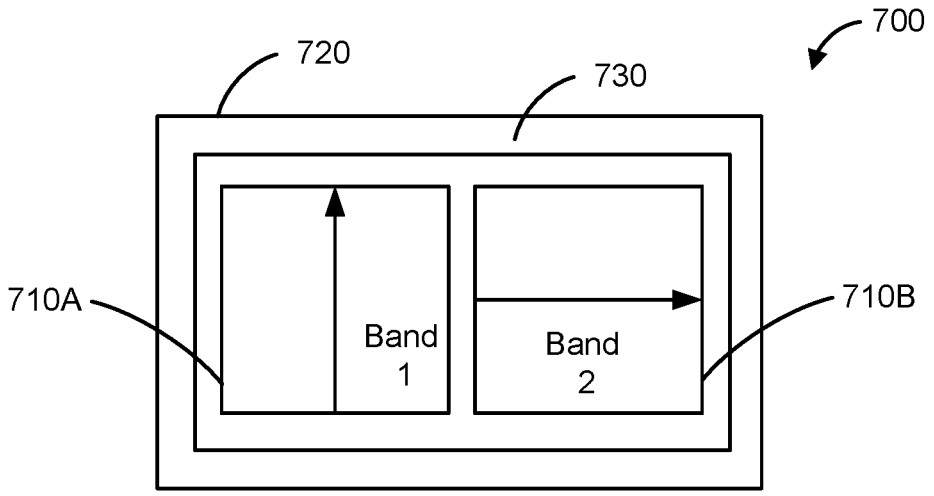
FIG. 7 is a schematic block diagram illustrating a flat panel antenna for dual band and selectable polarity operation according to some embodiments of the present invention.

Brief reference is now made to FIG. 7, which is a schematic block diagram illustrating a flat panel antenna for dual band and selectable polarity operation according to some embodiments of the present invention. The flat panel antenna 700 may include at least two FPAs 710 that may be operable to transmit, and/or receive electromagnetic energy having different polarizations and in different frequency bands. For example, FPA 710A may be configured to transmit and/or receive electromagnetic energy having a substantially vertical polarization in a first frequency band and 710B may be configured to transmit aid/or receive electromagnetic energy having a substantially horizontal polarization in a second frequency band that is different from the first frequency band.

In some embodiments, one of the FPAs 710 may be configured to operate in a transmit mode and the other one of the FPAs 710 may be configured to operate in a receive mode. Some embodiments provide that each of the FPAs 710 is configured to both transmit and receive. For example, operating both of the FPAs 710 in the same of the transmit, receive and/or transmit and receive modes may provide redundant electromagnetic signals that provide an error correction function.

Figure 6:
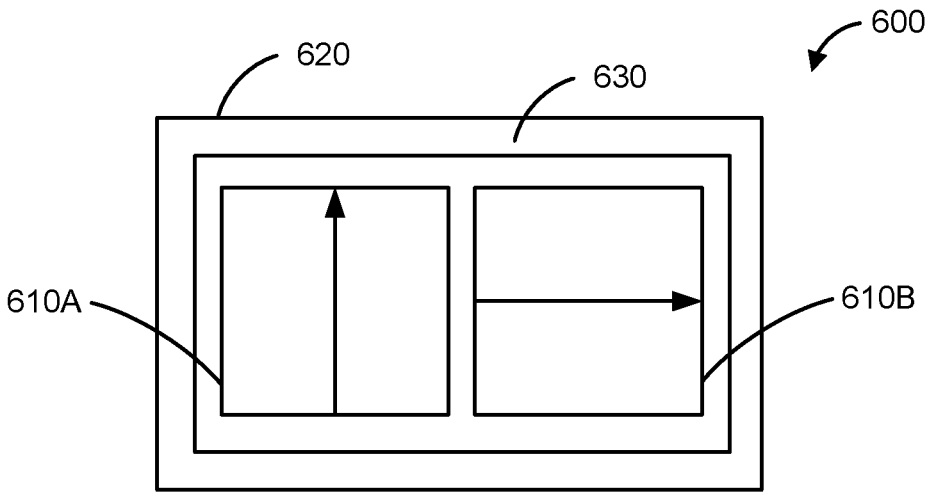
FIG. 6 is a schematic block diagram illustrating a flat panel antenna for single band and dual polarity operation according to some embodiments of the present invention.

In some embodiments, the flat panel antenna 700 may include antenna circuitry 730 which may provide, interconnection, coordination, control and/or configuration of the FPAs 710 which are described with reference to FIG. 6 above. As illustrated, the flat panel antenna 700 may include a single enclosure 720 that includes an internal cavity in which multiple flat panel arrays (FPAs) 710 may be provided. Other than dimensions, the enclosure 720 may include the same features as discussed above regarding FIG. 2. As such, additional description thereof will be omitted.

Additional cost or complexity corresponding to multiple FPAs may be recovered via benefits such as radio and/or system simplification, and/or antenna simplification. For example, single polarization FPAs may be simpler and thus less costly to manufacture that a dual polarization FPA. Some non-limiting examples of antennas and antenna systems including multiple FPAs are provided below in FIGS. 8A-12B, which compare conventional configurations and comparable configurations according to some embodiments herein.

Figure 8A:
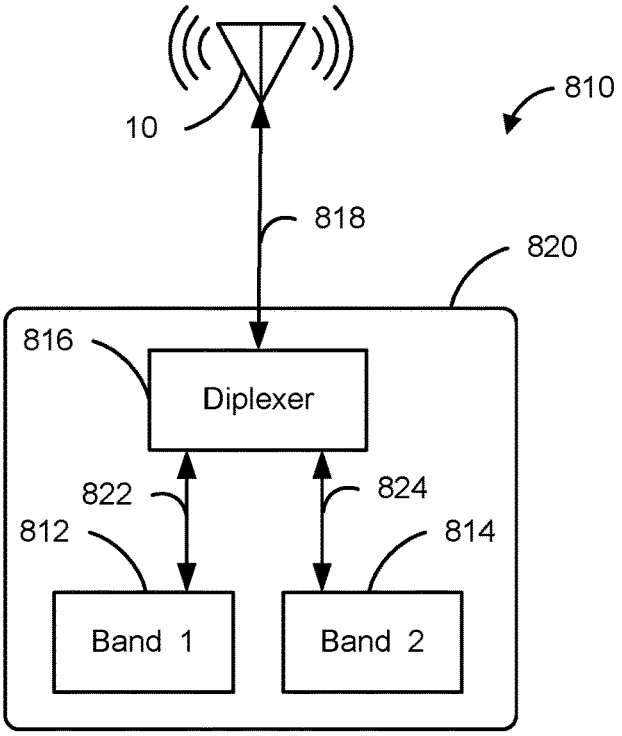
FIG. 8A (Prior Art)
FIG. 8A is a schematic block diagram illustrating a conventional dual band antenna system using a single antenna.

Brief reference is now made to FIG. 8A, which is a schematic block diagram illustrating a conventional dual band antenna system. As illustrated, the dual band antenna system 810 includes a single antenna 10 operating across a substantially wide frequency band. The single antenna 10 may be coupled to a diplexer 816 via one or more bi-directional communication links 818. The diplexer 816 may be further coupled to multiple radio modules 812 and 814 that are operable to transmit and receive communications in different respective frequency bands. For example, radio module 812 may be operable to transmit and receive communications in a first frequency band and radio module 814 may be operable to transmit in a second frequency band that is different from the first frequency band.

In use and operation, the diplexer 816 may be operable to separate two different frequency bands in the receive path and to combine the two different frequency bands in the transmit path. In such configurations, the frequency bands may be wide apart from one another in the frequency spectrum for the diplexer 816 to work satisfactorily. The diplexer 816 and radio modules 812 and 814 may be in a single radio 820 that may be in a single enclosure.

Figure 8B:
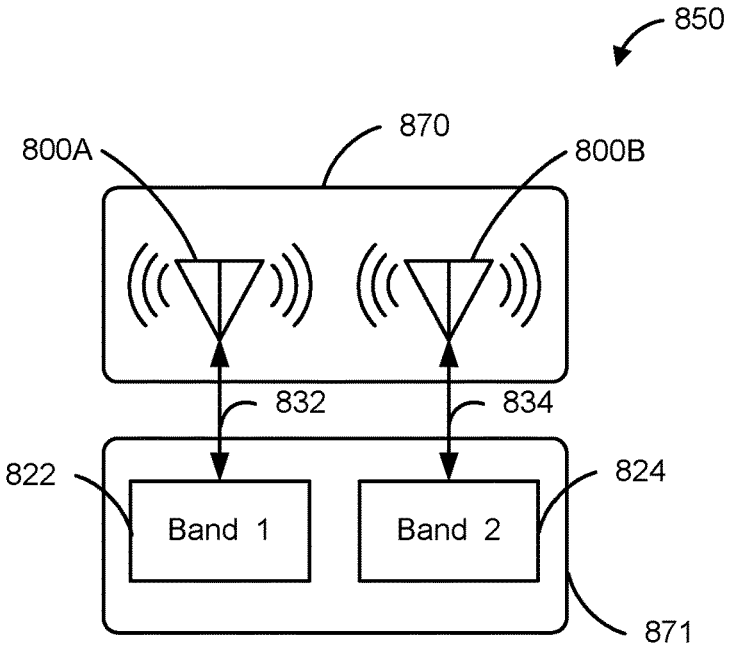
FIG. 8B is a schematic block diagram illustrating a dual band antenna system using a flat panel antenna having multiple antenna arrays according to some embodiments of the present invention.

In contrast, reference is now made to FIG. 8B is a schematic block diagram illustrating a dual band antenna system using a flat panel antenna having multiple antenna arrays according to some embodiments of the present invention. As illustrated, the dual band antenna system 850 includes an antenna enclosure 870 that may include multiple different FPAs 800A, 800B. The FPAs 800A, 800B may be operable to transmit and/or receive electromagnetic energy in different frequency bands relative to one another. The FPAs 800A, 800B may be coupled to respective radio modules 822, 824 that are operable to transmit and receive communications in the different respective frequency bands via respective bi-directional communication links 832, 834.

By using different FPAs 800A, 800B, the need for a diplexer and the cost and/or performance limitations corresponding to a diplexer may be avoided. For example, using separate FPAs 800A, 800B may reduce electromagnetic interference between the different frequency bands. As illustrated, the dual band antenna system 850 includes a dual band radio 871 that is separate from the antenna enclosure 870, however, some embodiments provide that only a single enclosure 870 or 871 may be included and that the system components including FPAs 800A, 800B, communication links 832, 834 and radio modules 822, 824 may be mounted in and/or on the single enclosure 870 or 871.

Figure 9A:
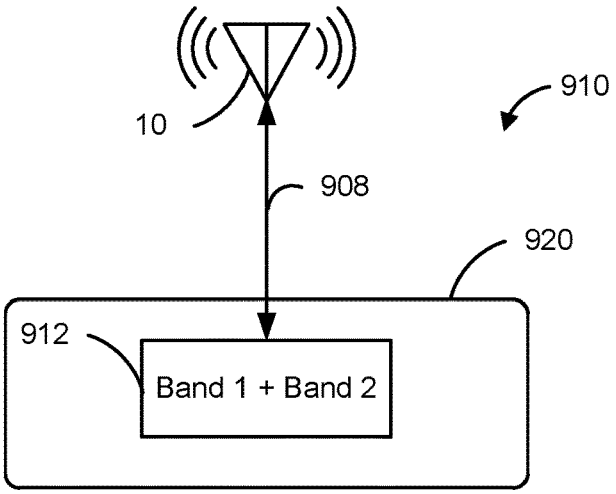
FIG. 9A (Prior Art)
FIG. 9A is a schematic block diagram illustrating a conventional antenna system using a diplexer to split a wide bandwidth channel into separate narrow bandwidth channels.
Figure 9B:
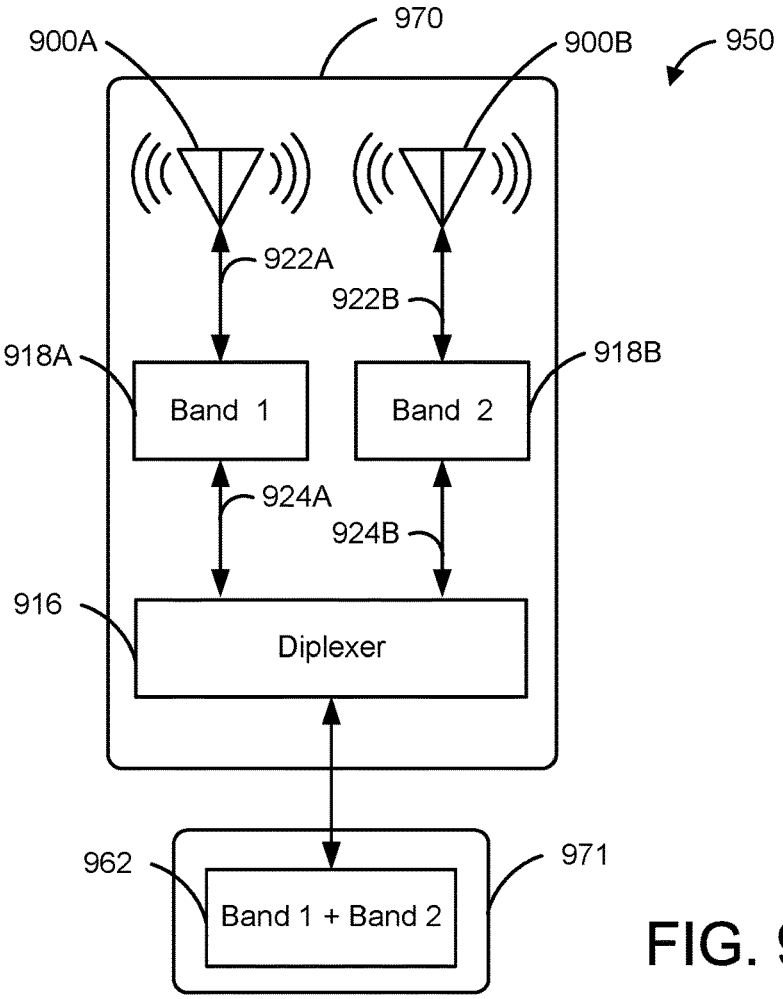
FIG. 9B is a schematic block diagram illustrating a dual band antenna system using a flat panel antenna having multiple antenna arrays according to some embodiments of the present invention.

Reference is now made to FIGS. 9A and 9B, which are schematic block diagrams illustrating a conventional antenna system using a diplexer to split a wide bandwidth channel of a single antenna into separate narrow bandwidth channels and a dual band antenna system using a flat panel antenna having multiple antenna arrays according to some embodiments of the present invention, respectively. Reference is made to FIG. 9A, which illustrates a conventional antenna system 910 using an antenna 10 that is coupled to a wide bandwidth radio module 912 that is in a wide bandwidth radio 920 via one or more bi-directional communication links 908. The wide bandwidth channel may include multiple narrow bandwidth channels that may include a first frequency band and a second frequency band. Some embodiments provide that the wide bandwidth radio module 912 and/or the antenna 10 may be mounted in and/or on the same enclosure.

Referring to FIG. 9B, a dual band antenna system 950 using a flat panel antenna having multiple antenna arrays may be provided according to some embodiments herein. As illustrated, the dual band antenna system 950 includes an antenna enclosure 970 that may include multiple different FPAs 900A, 900B. The FPAs 900A, 900B may be operable to transmit and/or receive electromagnetic energy in different frequency bands relative to one another. The FPAs 900A, 900B may be coupled to respective radio modules 918A, 918B that are operable to transmit and receive communications in the different respective frequency bands via respective bi-directional communication links 922A, 922B, respectively.

Each of the radio modules 918A, 918B may be coupled to a common diplexer 916 via respective bi-directional communication links 924A, 924B. By integrating the diplexer 916 into the interconnecting circuitry, the narrow bandwidth channels corresponding to the FPAs 900A, 900B and the radios 918A, 918B may be combined to provide a wide bandwidth channel, which may be processed by a wide bandwidth radio module 962 in a wide bandwidth radio 971. In this manner, narrow band antenna performance may be provided for wide bandwidth channels. As illustrated, although the dual band antenna system 950 includes a separate enclosure 970 for the antenna and the radio 971, some embodiments provide that only a single enclosure 970 or 971 may be included and that the antenna system components including FPAs 900A, 900B, communication links 922A, 922B, 924A, 924B, diplexer 916 and/or radio modules 918A, 918B, 962 may be mounted in and/or on the same enclosure 970.

Figure 10A:
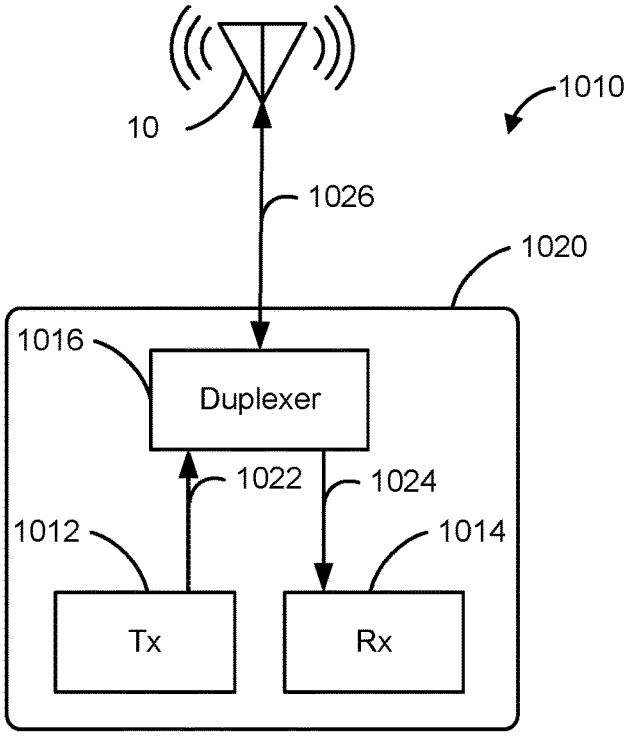
FIG. 10A (Prior Art)
FIG. 10A is a schematic block diagram illustrating a conventional duplexed antenna system.
Figure 10B:
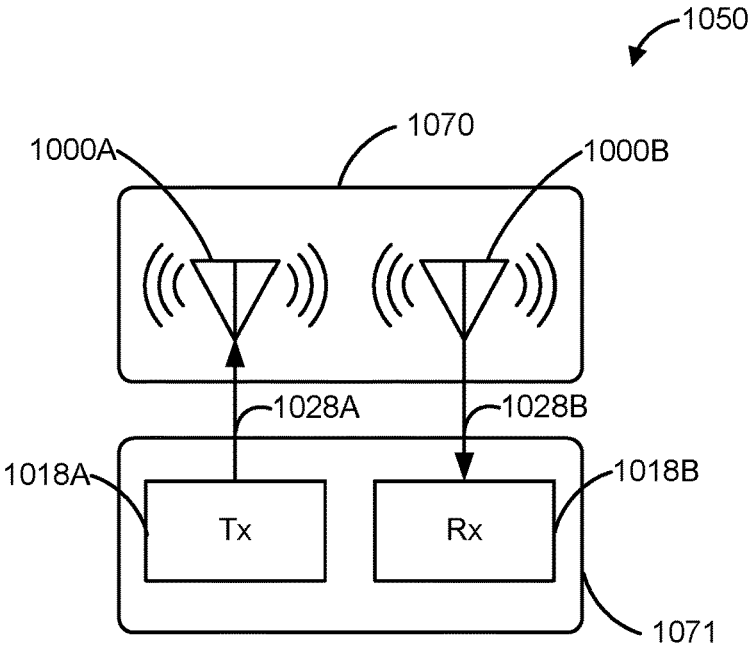
FIG. 10B is a schematic block diagram illustrating a dual band or dual polarity antenna system using a flat panel antenna having multiple antenna arrays according to some embodiments of the present invention.

Reference is now made to FIG. 10A, which is a schematic block diagram illustrating a conventional duplexed antenna system using a single antenna and FIG. 10B, which is a schematic block diagram illustrating a dual band or dual polarity antenna system using a flat panel antenna having multiple antenna arrays according to some embodiments of the present invention. FIG. 10A illustrates a conventional duplexed antenna system 1010 using an antenna 10 that is coupled to a duplexer 1016 via one or more bi-directional communication links 1026.

The duplexer 1016 may be coupled to a transmitter radio module 1012 using a first mono-directional communication link 1022 and a receiver radio module 1014 via a second mono-directional communication link 1024. For example, the first mono-directional communication link 1022 may be operable to communicate a signal from the transmitter radio module 1012 to the duplexer 1016 and the second mono-directional communication link 1024 may be operable to communicate a signal from the duplexer 1016 to the receiver radio module 1014. The duplexer 1016 may allow the use the single antenna 10 by both the transmitter radio module 1012 and the receiver radio module 1014. For example, the duplexer 1016 may couple the transmitter radio module 1012 and the receiver radio module 1014 to the antenna 10 while producing isolation between the transmitter radio module 1012 and the receiver radio module 1014. Some embodiments provide that the duplexer 1016, the transmitter radio module 1012, the receiver radio module 1014 and/or the antenna 10 may be mounted in and/or on an enclosure 1020.

Referring to FIG. 10B, dual band or dual polarity antenna system 1050 using a flat panel antenna having multiple antenna arrays is provided according to some embodiments herein. As illustrated, the dual band or dual polarity antenna system 1050 includes an antenna enclosure 1070 that may include multiple different FPAs 1000A, 1000B. The FPAs 1000A, 1000B may be configured to operate in different modes relative to one another. For example, FPA 1000A may be operated exclusively in a transmission mode based on signals communicated from the transmitter radio module 1018A via the mono-directional communication link 1028A. In contrast, FPA 1000B may be operated exclusively in a receive mode and may communicate received signals to the transmitter radio module 1018B via the mono-directional communication link 1028B.

In some embodiments, the FPAs 1000A, 1000B may be operated at the same frequencies and/or different frequencies relative to one another. Additionally, the FPAs 1000A, 1000B may radiate electromagnetic energy having the same polarization as one another and/or different polarizations relative to one another. By using two separate FPAs 1000A, 1000B, receive and transmit radio modules 1018A and 1018B may be used without a duplexer. In this manner the antenna system 1050 may include a more simple design and may provide improved performance by increasing the isolation between the transmitter radio module 1018A and the receiver radio module 1018B.

As illustrated, although the dual band antenna system 1050 includes an antenna enclosure 1070 the dual mode radio 1071 illustrated as separate components. However, some embodiments provide that some or all of the remaining components including FPAs 1000A, 1000B, communication links 1028A, 1028B, and/or radio modules such as transmitter radio module 1018A and receiver radio module 1018B, may be mounted in and/or on the same enclosure.

Figure 11A:
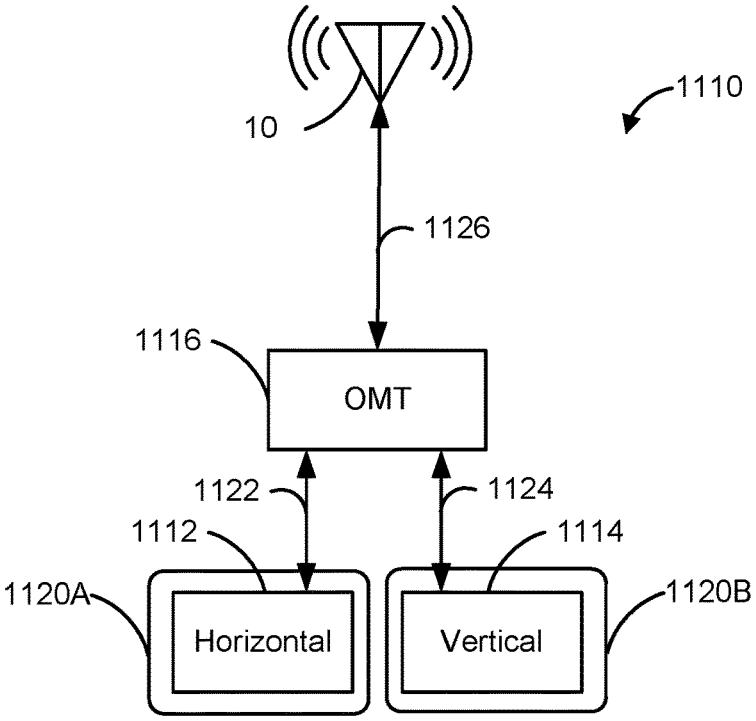
FIG. 11A (Prior Art)
FIG. 11A is a schematic block diagram illustrating a conventional orthogonally polarized antenna system having two single polarization radios.
Figure 11B:
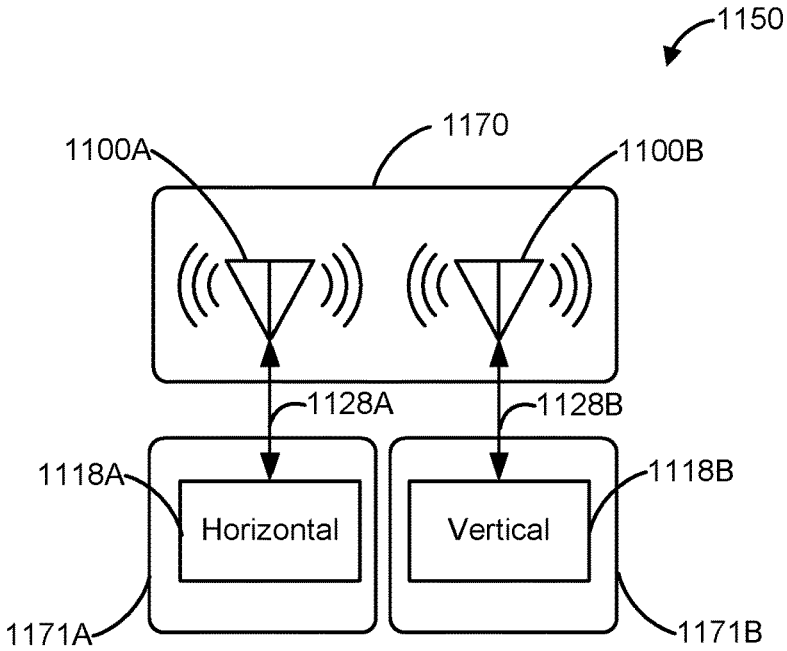
FIG. 11B is a schematic block diagram illustrating an orthogonally polarized antenna system having two single polarization radios and using a flat panel antenna having multiple antenna arrays according to some embodiments of the present invention.

Reference is now made to FIG. 11A, which is a schematic block diagram illustrating a conventional orthogonally polarized antenna system having two single polarization radios and using an orthomode transducer and a single antenna and FIG. 11B, which is a schematic block diagram illustrating an orthogonally polarized antenna system having two single polarization radios and using a flat panel antenna having multiple antenna arrays according to sortie embodiments of the present invention. FIG. 11A illustrates a conventional orthogonally polarized antenna system 1110 that includes two single polarization radios 1120A, 1120B. For example, single polarization radio 1120A includes a horizontal polarization radio module 1112 and single polarization radio 1120B includes a vertical polarization radio module 1114. Each of the horizontal and vertical polarization radio modules may be coupled to a single antenna 10 via an orthomode transducer (OMT) 1116 via one or more bi-directional communication links 1122, 1124, 1126.

As used herein, an OMT 1116 may include a waveguide component that may combine and/or separate two orthogonally polarized microwave signal paths (i.e., horizontal and vertical). As illustrated, the OMT 1116 may be coupled to an antenna 10 via bidirectional communication link 1126 and to the horizontal radio module 1112 that is operable to transmit and receive signals corresponding electromagnetic energy that has a horizontal polarization via a bi-directional communication link 1122. Additionally, the OMT 1116 may be coupled to the vertical radio module 1114 that is operable to transmit and receive signals corresponding to electromagnetic energy that has a horizontal polarization via a bi-directional communication link 1124. By using the OMT 1116, the antenna system 1110 may be operable to transmit and receive electromagnetic energy having both a horizontal and vertical polarization. The horizontal and vertical radio modules 1112, 1114 may be included in separate respective radios 1120A, 1120B.

Reference is now made to FIG. 11B, which illustrates an orthogonally polarized antenna system 1150 having two single polarization radios 1171A, 1171B using a flat, panel, antenna having multiple antenna arrays is provided according to some embodiments herein. As illustrated, the orthogonally polarized antenna system 1150 includes an antenna enclosure 1070 that may include multiple different FPAs 1100A, 1100B. The FPAs 1100A, 1100B may be operable to transmit and/or receive electromagnetic energy having different polarizations relative to one another. For example, FPA 1100A may radiate electromagnetic energy having a horizontal polarization and FPA 1100B may transmit and/or receive electromagnetic energy having a vertical polarization. Some embodiments provide that FPA 1100A may receive and/or transmit horizontally polarized signals to/from a horizontal radio module 1118A in radio 1171A via a bi-directional communication link 1128A. Similarly, some embodiments provide that FPA 1100B may receive and/or transmit vertically polarized signals to/from the vertical radio module 1128B in radio 1171B via a bi-directional communication link 1128B. In this manner, dual polarization operation may be provided using the FPAs 1100A, 1100B instead of requiring an OMT.

In some embodiments, the FPAs 1100A, 1100B may be operated at the same frequencies and/or different frequencies from one another. By using two separate FPAs 1100A, 1100B, horizontal and vertical radio modules 1118A and 1118B may be used without an OMT. In this manner the antenna system 1050 may include a more simple design and may provide improved performance by increasing the isolation between the horizontal radio module 1118A and the vertical radio module 1118B.

As illustrated, although the dual polarization antenna system 1150 includes separate enclosure 1170 and single polarization radios 1171A and 1171B, some embodiments provide that the components including FPAs 1100A, 1100B, communication links 1128A, 1128B, and/or radio modules 1118A, 1118B, may be mounted in and/or on a single enclosure.

Figure 12A:
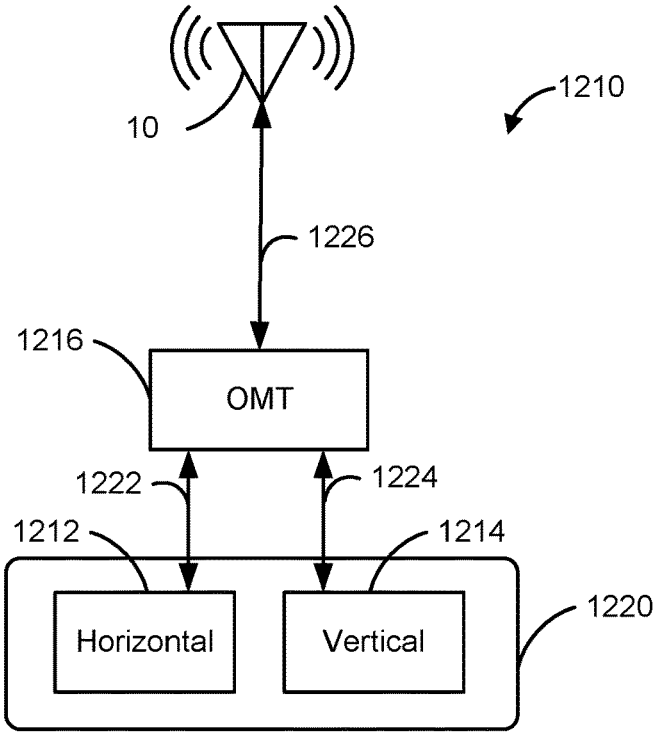
FIG. 12A (Prior Art)
FIG. 12A is a schematic block diagram illustrating a conventional orthogonally polarized antenna system having one dual polarization radio.
Figure 12B:
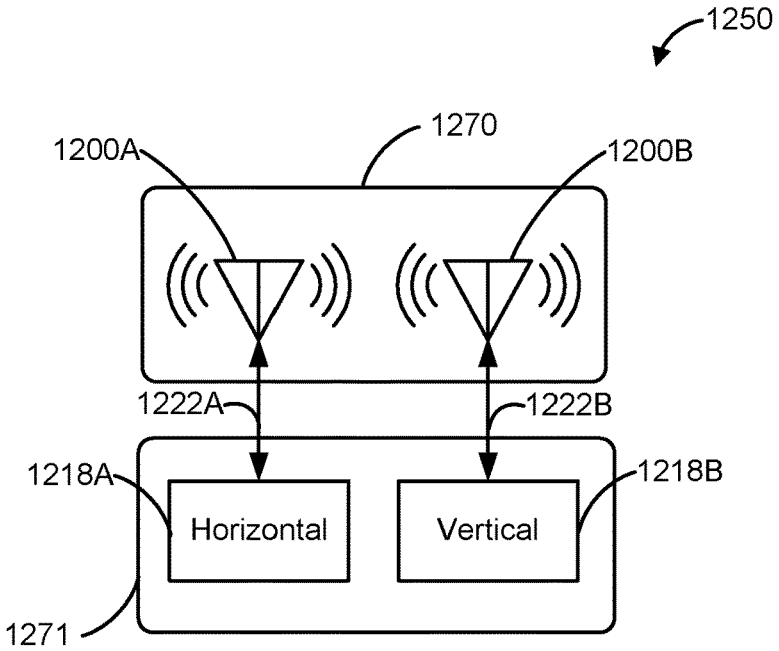
FIG. 12B is a schematic block diagram illustrating an orthogonally polarized antenna system having one dual polarization radio and using a flat panel antenna having multiple antenna arrays according to some embodiments of the present invention.

Brief reference is now made to FIG. 12A, which is a schematic block diagram illustrating a conventional orthogonally polarized antenna system having one dual polarization radio and using a single antenna and FIG. 12B, which is a schematic block diagram illustrating an orthogonally polarized antenna system having one dual polarization radio and using a flat panel antenna having multiple antenna arrays according to some embodiments of the present invention.

FIG. 12A is similar to FIG. 11A except that instead of using two different single polarization radios 1171A, 1171B having respective horizontal and vertical radio modules 1118A, 1118B, FIG. 12A includes a dual polarization radio 1220 including both horizontal and vertical radio modules 1212, 1214. As such, additional description of FIG. 12A will be omitted.

Reference is made to FIG. 12B, which is similar to FIG. 11B except that instead of using two different single polarization radios 1120A, 1120B in FIG. 11, FIG. 12B includes one dual polarization radio 1271 that includes a horizontal radio module 1218A and a vertical radio module 1218B that are connected to the FPAs 1200A, 1200B, respectively, via bidirectional communication links 1222A, 1222B, respectively. As such, additional description of FIG. 12B will be omitted.

From the foregoing, it will be apparent that embodiments of the present invention provide a high performance flat panel antenna with improved dual-band, multiple polarization performance while reducing potential complexity and/or expense.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

Unless otherwise defined, all technical and scientific terms used herein have the same meaning as commonly understood by one of ordinary skill in the art to which this invention belongs. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Aspects and elements of all of the embodiments disclosed above can be combined in any way and/or combination with aspects or elements of other embodiments to provide a plurality of additional embodiments.

In the drawings and specification, there have been disclosed typical embodiments of the invention and, although specific terms are employed, they are used in a generic and descriptive sense only and not for purposes of limitation, the scope of the invention being set forth in the following claims.

That which is claimed:

1. A flat panel antenna, comprising:

a plurality of flat panel arrays (FPAs) that are arranged adjacent one another, wherein ones of the plurality of FPAs are configured to be coupled to at least one radio to transmit and/or receive communication signals via respective data communication links in a plurality of different respective frequency bands and/or at different respective polarizations; and an enclosure that defines an internal cavity that includes the plurality of FPAs.

2. The flat panel antenna of claim 1, wherein the plurality of FPAs comprise a first FPA that is configured to transmit and/or receive communication signals having a vertical polarization and a second FPA that is configured to transmit and/or receive communication signals having a horizontal polarization.

3. The flat panel antenna of claim 1, wherein the plurality of FPAs comprise a first FPA that is configured to exclusively operate in a transmit mode and a second FPA that is configured to exclusively operate in a receive mode.

4. The flat panel antenna of claim 2, wherein the first FPA is configured to operate in a first frequency band and the second FPA is configured to operate in a second frequency band that is different from the first frequency band.

5. The flat panel antenna of claim 4, wherein the first frequency band and the second frequency band are narrow bands that have a frequency range of less than about 10 GHz.

6. The flat panel antenna of claim 5, wherein the first frequency band comprises a 71-76 GHz frequency band and the second frequency band comprises a 81-86 GHz frequency band.

7. The flat panel antenna of claim 5, wherein the plurality of FPAs are configured to transmit and/or receive communication signals in a wide frequency band that includes both of the first frequency band and the second frequency band.

8. The flat panel antenna of claim 1, wherein the plurality of FPAs comprise:

a first FPA that is configured to operate in a first frequency band; and a second FPA that is configured to operate in the first frequency band, wherein a polarization difference between the first FPA and the second FPA is about ninety degrees.

9. The flat panel antenna of claim 8, wherein the plurality of FPAs further comprise:

a third FPA that is configured to operate in a second frequency band; and a fourth FPA that is configured to operate in the second frequency band, wherein a polarization difference between the third FPA and the fourth FPA is about ninety degrees.

10. The flat panel antenna of claim 1, wherein the plurality of FPAs comprise:

a first FPA that is configured to transmit or receive communication signals having a vertical polarization in a first frequency band;

a second FPA that is configured to transmit or receive communication signals having a horizontal polarization in the first frequency band;

a third FPA that is configured to transmit or receive communication signals having the vertical polarization in a second frequency band that is different from the first frequency band; and a fourth FPA that is configured to transmit or receive communication signals having the horizontal polarization in the second frequency band.

11. The flat panel antenna of claim 10, wherein the at least one radio comprises a first radio and a second radio, wherein the first FPA and the third FPA are configured to be coupled to the first radio, and wherein the second FPA and the fourth FPA are configured to be coupled to the second radio.

12. The flat panel antenna of claim 10, wherein the first FPA and the third FPA are configured to transmit the communication signals, and wherein the second FPA and the fourth FPA are configured to receive the communication signals.

13. The flat panel antenna of claim 10, wherein the first, second, third and fourth FPAs are arranged in a two column, two row configuration, and wherein the second FPA is in a first row and a first column, the third FPA is in the first row and a second column, the fourth FPA is in a second row and the first column, and the first FPA is in the second row and the second column.

14. The flat panel antenna of claim 1, wherein each of the plurality of FPAs is a rectangular shaped FPA and has a polarization direction that extends diagonally across the rectangular shaped FPA from a first corner to a second corner that is opposite the first corner, wherein the plurality of FPAs comprise:

a first FPA that is configured to transmit or receive communication signals having a vertical polarization in a first frequency band;

a second FPA that is configured to transmit or receive communication signals having a horizontal polarization in the first frequency band;

a third FPA that is configured to transmit or receive communication signals having the vertical polarization in a second frequency band that is different from the first frequency band; and a fourth FPA that is configured to transmit or receive communication signals having the horizontal polarization in the second frequency band.

15. The flat panel antenna of claim 14, wherein the plurality of FPAs are arranged in a diamond shaped configuration, and wherein the enclosure is substantially rectangular and is arranged such that a corner of each of the plurality of FPAs is positioned along a corresponding side of the enclosure.

16. The flat panel antenna of claim 14, wherein the plurality of FPAs are arranged in a diamond shaped configuration, and wherein the enclosure is substantially diamond shaped and is arranged such that each corner of the enclosure is positioned adjacent a corner of a different one of the plurality of FPAs.

17. The flat panel antenna of claim 1, wherein the at least one radio comprises a first radio and a second radio, and wherein the plurality of FPAs comprise:

a first FPA that is configured to operate in a first frequency band; and a second FPA that is configured to operate in a second frequency band that is different from the first frequency band, the antenna further comprising:

the first radio that is coupled to the first FPA;

the second radio that is coupled to the second FPA; and a diplexer that is coupled to the first radio and the second radio.

18. The flat panel antenna of claim 17, wherein the first frequency band and the second frequency band are each a narrow frequency band channel, and wherein the diplexer is operable to combine a first frequency band channel from the first radio and a second frequency band channel from the second radio into a wideband channel in a receive mode.

19. The flat panel antenna of claim 17, wherein the first frequency band and the second frequency band are each a narrow frequency band channel, and wherein the diplexer is operable to separate a wideband channel into a first frequency band channel and a second frequency band channel in a transmit mode.

20. The flat panel antenna of claim 1, further comprising at least one electromagnetic decoupling structure that is positioned adjacent one or more of the plurality of FPAs and that is configured to reduce electromagnetic interference between ones of the plurality of FPAs.

21. A method of manufacturing a flat panel antenna, the method comprising:

providing a plurality of flat panel arrays (FPAs) that are arranged adjacent one another, wherein ones of the plurality of FPAs are configured to be coupled to at least one radio to transmit and/or receive communication signals via respective data communication links in a plurality of different respective frequency bands and/or at different respective polarizations; and providing an enclosure that defines an internal cavity that includes the plurality of FPAs.

22. The method of claim 21, wherein the plurality of FPAs comprise a first FPA that is configured to transmit and/or receive communication signals having a vertical polarization in a first frequency band, and a second FPA that is configured to transmit and/or receive communication signals having a horizontal polarization in a second frequency band that is different from the first frequency band.

* * * * *